US006517938B1

(12) United States Patent
Andoh et al.

(10) Patent No.: US 6,517,938 B1
(45) Date of Patent: Feb. 11, 2003

(54) ARTIFICIAL LEATHER SHEET SUBSTRATE AND PRODUCTION PROCESS THEREOF

(75) Inventors: Hidekazu Andoh, Kurashiki (JP); Tsuyoshi Yamasaki, Kurashiki (JP); Yoshihiro Tamba, Kurashiki (JP)

(73) Assignee: Kurray Co., Ltd., Kurashiki (JP)

( * ) Notice: Subject to any disclaimer, the term of this patent is extended or adjusted under 35 U.S.C. 154(b) by 0 days.

(21) Appl. No.: 09/526,465

(22) Filed: Mar. 16, 2000

(30) Foreign Application Priority Data

Mar. 16, 1999 (JP) ..... 11-069391

(51) Int. Cl.[7] ..... D02G 3/00

(52) U.S. Cl. ..... 428/395; 428/15; 428/85; 428/151; 428/903; 428/904; 428/391; 428/396; 428/397; 428/401; 442/60; 442/168; 442/169; 442/334; 442/340

(58) Field of Search ..... 428/15, 85, 151, 428/904, 903, 364, 365, 375, 378, 391, 395, 396, 397, 401; 442/60, 164, 168, 169, 327, 334, 335, 340

(56) References Cited

U.S. PATENT DOCUMENTS 5,503,899 A 4/1996 Ashida et al.
5,876,466 A 3/1999 Nakashima et al.
5,993,944 A * 11/1999 Honna et al.
6,299,977 B1 * 10/2001 Takeyama et al.
6,322,851 B1 * 11/2001 Adachi et al.

OTHER PUBLICATIONS

"Encyclopedia of Polymer Science and Engineering" Second Edition, vol. 11, 1998 pp. 445–446 (no month).

* cited by examiner

*Primary Examiner*—Deborah Jones
*Assistant Examiner*—Wendy Boss
(74) *Attorney, Agent, or Firm*—Oblon, Spivak, McClelland, Maier & Neustadt, P.C.

(57) ABSTRACT

An artificial leather sheet substrate comprising: a fiber entangled nonwoven fabric composed of bundles of a polyamide-based microfine fibers comprising a polyamide or a polyamide composition having a hot toluene swelling degree of 2 to 10%, and having a fineness of 0.1 decitex or less; and an elastic polymer and a releasing agent between the bundles, the releasing agent being also added to the inside of the bundles. This leather-like sheet substrate is soft and is excellent in denseness, dyeability and color fastness. The sheet is suitable, as a suede-like artificial leather or a grain surface like artificial leather, for fields for which high quality is required, for example, for clothing. The sheet is high in denseness of surface napped fiber and is excellent in hand touch, writing effect and draping ability, especially as a suede-like artificial leather. According to the present invention, the shrinkage ratio, which is unstable according to producing methods in the prior art, can be obtained stably in the industry.

17 Claims, No Drawings

ARTIFICIAL LEATHER SHEET SUBSTRATE AND PRODUCTION PROCESS THEREOF

BACKGROUND OF THE INVENTION

1. Field of the Invention

The present invention relates to a sheet that is used as a substrate of a suede-like or smooth-like artificial leather sheet, and a production process thereof. Specifically, the present invention relates to an artificial leather substrate that is soft and dense, and has excellent processability.

2. Description of the Background

Hitherto, a fiber-entangled nonwoven fabric that is used as an artificial leather sheet substrate is usually subjected to a shrinking treatment in order to improve softness and denseness of an artificial leather sheet. Since early times, for fiber-entangled nonwoven fabrics comprising a polyamide-based fiber, many techniques have been suggested for shrinking the fiber by treating the polyamide-based fiber in the fiber-entangled nonwoven fabric with an aqueous solution of calcium chloride, zinc chloride or lithium chloride, or an aqueous solution or a dispersion solution of phenol, benzylalcohol, benzoic acid or the like, and swelling the fiber.

Incidentally, in the case of fiber-entangled nonwoven fabrics comprising polyester fiber, there is known a technique of using the property that a low draw ratio fiber or a high-speed spun fiber of polyethylene telephthalate has thermal shrinkage to shrink and densify the fiber-entangled nonwoven fabrics. For example, Japanese Patent Publications No. 53-20561 and No. 53-20562 describe production of a suede-like artificial leather by treating a woven fabric of multi-component fiber comprising polyamide and polyester with a chemical agent such as benzyl alcohol so as to shrink and exfoliate the polyamide component.

Japanese Patent Laid-Open No. 3-90619 describes a process for producing a fabric using a polyamide/polyester-based separate-type composite fiber, which comprises treating a cylindrical or flat woven fabric comprising the copolymerized polyamide/polyester-based separate-type composite fiber with a heated alkali solution to separate the fiber constituting polymers, shrink the fiber, and consequently obtain the surface covered with only the microfine polyester fiber, and then developing the woven fabric with only a dye for the polyester fiber.

Japanese Patent No. 2786868 describes a process for producing a suede-like artificial leather sheet, which comprises the steps of treating a nonwoven fabric composed of sea-island section fiber comprising polyamide as an island component and polyethylene as a sea component with an aqueous solution of benzoic acid to shrink the polyamide.

As described above, in these methods the polyamide-based fiber is treated with an aqueous solution or a dispersion solution of an agent such as phenol, benzylalcohol or benzoic acid, to swell or shrink the fiber. According to these methods, however, a change in the concentration of the treating solution is easily caused by evaporation or sublimation. There arises a serious problem that stabilization of the shrinkage ratio is difficult by the change. Moreover, the polyamide-based fiber deteriorates easily by the swelling or shrinking treatment. There is also a problem in the technique for controlling it.

The chemical agents described above have a serious problem with respect to safety. Accordingly, satisfactory measures must be taken for a working environment or against environmental pollution, and facilities for recollecting the used chemical agents are essential. Thus, a large burden is imposed on industrial production.

Recently, the degree of the demand about the hand touch, the sense of the touch or color is increasing large year by year. For example, the number of colors is increased, and it is important that the difference in color between the external layer and the internal layer in the section of an artificial leather sheet is reduced. For example, in the case that in a post step dyeing is applied to the artificial leather sheet comprising a polyester-based fiber entangled nonwoven fabric and a polyurethane-based elastic polymer, the color fastness thereof becomes very low when the disperse dye with which the fiber is dyed sticks to the polyurethane. Therefore, the following dyeing method is used: a method of dyeing the polyester fiber with the disperse dye, removing the disperse dye stuck to the polyurethane, and re-dyeing the polyurethane with a metal complex dye. In such a method, however, the steps are complicated. There also remains such a problem that when a resin is applied to the surface to turn it into a smooth-like surface or the surface is thermally embossed to obtain grains, the disperse dye in the polyester fiber is transferred to the polyurethane so that the color fastness drops.

When an artificial leather sheet comprising a polyamide-based fiber entangled nonwoven fabric and a polyurethane-based polymer is dyed with a metal complex dye in a post dyeing step, relatively good color fastness can be expected. However, it becomes insufficient to shrink and densify the fiber entangled nonwoven fabric. Thus, it is difficult to obtain sheet having dense feeling like natural leather. This artificial leather sheet has a problem that the feeling thereof is soft but is like rubber.

The suede-like product also has a problem that if importance is attached to softness, contact points of its fiber and polyurethane polymer must be made fewer, and in this case its surface napped fiber falls out.

SUMMARY OF THE INVENTION

In the light of the problems described above, an object of the present invention is to provide an artificial leather sheet substrate that is soft and dense, and is excellent in processability and that is obtained by shrinkage-processing a nonwoven fabric which comprises a polyamide-based microfine fiber-forming fiber and which is easy in handling and results in stable shrinkage ratio; and a production process thereof.

Thus, the present invention provides an artificial leather sheet substrate, comprising:

- a fiber entangled nonwoven fabric composed of bundles of a polyamide-based microfine fibers comprising a polyamide or a polyamide composition having a hot toluene swelling degree of 2 to 10%, and having a fineness of 0.1 decitex or less;
- an elastic polymer and a releasing agent between the bundles; and
- a releasing agent inside of the bundles.

Preferable is the above-mentioned polyamide-based fiber is a fiber comprising a polyamide or a polyamide composition comprising a nylon-6 unit and a nylon- 12 unit. Preferable is also the above-mentioned artificial leather sheet substrate, wherein the releasing agent present between the microfine fiber bundles and inside the microfine fiber bundle is a salt compound of a polyamide derivative and a silicone-based compound.

The present invention is a process for producing an artificial leather sheet substrate comprising a polyamide-based microfine fiber and an elastic polymer, comprising:

producing a fiber entangled nonwoven fabric from a polyamide microfine fiber-forming fiber, treating the fiber entangled nonwoven fabric with hot water to shrink the fabric by 15 to 50% in area, impregnating the shrunk fiber entangled nonwoven fabric with an elastic polymer, converting the microfine fiber-forming fiber into bundles of microfine fine fibers, adding a releasing agent to the bundles of microfine fine fibers, and drying the bundles of microfine fine fibers.

A more complete appreciation of the invention and many of the attendant advantages thereof will be readily obtained as the same becomes better understood by reference to the following detailed description.

DETAILED DESCRIPTION OF THE INVENTION

The microfine fiber-forming fiber in the present invention may be a fiber having a sea-island section structure where its island component comprises a polyamide having the above-mentioned swelling degree and its sea component is preferably polyethylene, and more preferably low-density polyethylene. As the method for converting the microfine fiber-forming fiber to bundles of microfine fibers, there is generally used a method of extracting and removing polyethylene as the sea component with hot toluene at 75 to 95° C. The polyamide-based fiber having the swelling degree defined in the present invention has a very satisfactory property that the fiber is uniformly shrunk and the degree of the shrinkage can be freely controlled. However, in the step of converting the polyamide-based fiber to the bundle of the microfine fibers, in general the polyamide-based fiber is easily swelled with hot toluene. In the step of press in hot toluene for promoting extraction and removal, the phenomenon of adhesion between the microfine fibers is easily caused between the bundles of the microfine fibers and inside the bundle of the microfine fibers. When the adhesion between the microfine fibers is excessive, the hand touch of the resultant product becomes hard and further its suede-like surface has undesirable appearances and feel.

The hot toluene swelling degree of the polyamide forming the polyamide-based microfine fiber in the present invention is from 2 to 10%, and preferably 4 to 7%. These ranges include all specific values and subranges therebetween such as 3, 5, 6, 8 and 9%. If the swelling degree is less than 2%, the polyamide based microfine fiber cannot exhibit performances such as softness and denseness, resulting from shrinkage with hot water of the nonwoven fabric in the present invention. If the above-mentioned swelling degree is more than 10%, the adhesion between the microfine fibers is too high. Thus, even if an adhesion-blocking agent is added or an adhesion-releasing treatment is conducted in any subsequent step, the effect thereof cannot be produced.

In the present invention, after converting the microfine fiber-forming fiber into the bundles of microfine fibers, a releasing agent, that is, an adhesion-blocking agent is added thereto. The releasing agent is preferably a salt compound of a polyamide derivative or a silicone-based compound. The salt compound of the polyamide derivative is especially preferred because the compound is easily subjected to buffing with sandpaper to obtain a suede-like artificial leather and the compound slightly has an influence on the sense of the touch of the surface. The percentage of the releasing agent is from 0.2 to 1.0% (solid basis) and preferably 0.4 to 0.6% by weight of the sheet substrate because the agent compound slightly has an influence on the sense of the touch of the surface. In the present invention, a preferred example of the polyamide derivative is a compound represented by the general formula:

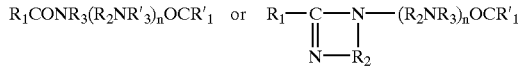

where $R_1$ and $R'_1$ each represents an alkyl group having 11 to 25 carbon atoms, $R_2$ is an alkylene group having 2 to 3 carbon atoms, $R_3$ and $R'_3$, which may be the same or different, are H or an intermolecular crosslink bond and n is an integer of 1 to 8; a polycondensate obtained by polycondensation of the above-mentioned compound with epihalohydrin; or the like. Specific examples of a salt compound thereof include any compound represented by the following chemical formulas 1, 2, 3 and 4. Above all, the compound represented by the chemical formula 1 is more preferred because the compound is easily subjected to buffing with sandpaper and the compound slightly has an influence on the sense of the touch of the surface.

Formula 1:

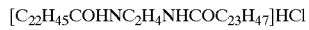

Formula 2:

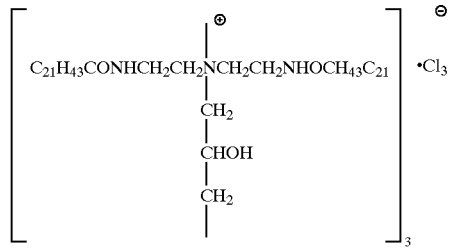

Formula 3:

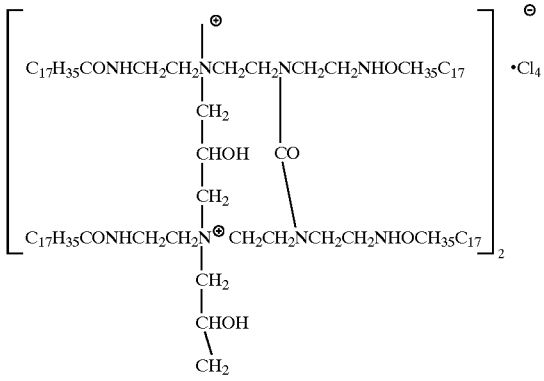

Formula 4:

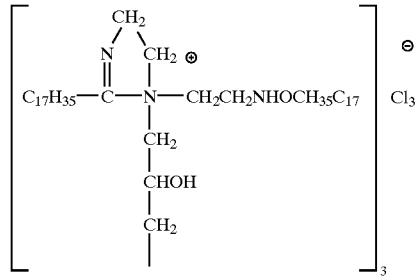

The polyamide derivative used in the present invention is a compound represented by the above-mentioned general formula and obtained by dehydration-condensing a higher fatty acid whose alkyl group has from 11 to 25 carbon atoms and polyalkylenepolyamine whose alkylene group has 2 or 3 carbon atoms and, if necessary, crosslinking the resultant with urea or thiourea, or can be obtained by polycondensing the above-mentioned compound with epihalohydrin. Examples of the used higher fatty acid include lauric acid, myristic acid, palmitic acid, stearic acid, arachidinic acid, and behenic acid. Above all, a higher fatty acid whose alkyl group has 17 or more carbon atoms is preferred. Examples of the polyalkylenepolyamine include ethylenediamine, diethylenetriamine, triethylenetetramine, tetraethylenepentamine, propylenediamine, and dipropylenetriamine. When the polyamide derivative is reacted with epihalohydrin, the polyamide derivative is cationized and crosslinked because epihalohydrin is a bifunctional compound. As a result, a salt compound is obtained.

Examples of the silicone-based compound include compounds represented by the chemical formula 5, and specifically include dimethylsilicone, methylphenylsilicone, methylhydrogen silicone, amino-modified silicone, and alkyl-modified silicone. Above all, amino-modified silicone is preferred because it has high releasing effect.

Formula 5:

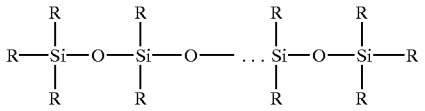

wherein the R groups are methyl groups, a part of which may be replaced by a phenyl group, a long -chain alkyl group, a trifluoropropyl group, an amino group or the like.

It is preferred to add the releasing agent to the substrate by immersing the substrate into an aqueous solution of the releasing agent in the following states and dry the substrate: the state that polyethylene of the sea component is extracted with hot toluene and removed to convert the microfine fiber-forming fiber into microfine fiber bundles, and in the state that the substrate after the toluene remaining in the substrate is removed by azeotropy is still wet and portions of false adhesion between the microfine fibers are not fixed. In the case of performing conversion into the bundles of the microfine fibers, removal of the remaining toluene by azeotropy with hot water and drying treatment to remove water substantially completely, and subsequently giving the releasing agent, the portions of the false adhesion between the microfine fibers are already fixed. Thus, the effect of the releasing agent cannot be sufficiently expected.

A preferred example of the polyamide that is an island component of the microfine fiber-forming fiber constituting the present invention is a polyamide or a polyamide composition wherein the weight ratio of 6-nylon units and 12 nylon units is from 60/40 to 95/5. This range includes all specific values and subranges therebetween, such as 65/35, 70/30, 75/25, 80/20, 85/15 and 90/10. More preferred is the above-mentioned polyamide or polyamide composition having a melting point of 185° C. or higher. An example of such a polyamide or a polyamide composition is a polyamide or a polyamide composition which mainly contains the 6-nylon units and "comprises" the 12-nylon units within the above-mentioned range of the weight ratio, and which may "comprise" about 30% or less by weight of one or more components selected from nylon-66 units, nylon-6I units (polymer units of hexamethylenediamine and isophthalic acid), nylon-610 units and the like. The term "comprise" referred to in the present invention means existence both in the state of copolymerization and in the state of blend. The copolymerization may be any one of copolymerization in block, random and graft states and the like states. Preferred examples include a two-component copolymer of 6-nylon and 12-nylon, and a three-component copolymer of 6-nylon, 66-nylon and 12-nylon. A desired melting point can be obtained by combining the number and the ratio of components to be copolymerized, and copolymerization state. Preferred is a block copolymer, having a crystallinity after turning into fiber, wherein the 6 -nylon unit and the 12 -nylon unit which each has an appropriate length are linked to each other in a block form. Of course, in the present invention another polymer or other polymers may be blended with the above-mentioned polyamide or polyamide composition unless the object of the present invention is damaged.

When the percentage of the 12-nylon unit is 5% or less by weight of the total amount of the 12-nylon unit and the 6-nylon unit, the 6-nylon keeps high crystallinity so that the hot toluene swelling ratio is 2% or less. In this case, the adhesion between the microfine fibers is not caused but a desired hot water shrinkage ratio cannot be obtained. When the percentage of copolymer components is set to 40% or more by weight, thereby dropping the crystallinity, to improve the hot water shrinkage ratio, the melting point drops excessively. Thus, at the time of spinning or post-finishing, the polyamide or the polyamide composition melts or discomposes easily. Therefore, the resultant fiber-entangled nonwoven fabric has low strength and high hot toluene swelling degree so that the adhesion between the microfine fibers is highly caused. Thus, this fabric is low in practicability.

In order to perform post-processing such as dyeing or thermosetting satisfactorily, it is necessary that this polyamide has a melting point of 185° C. or higher. Preferably, this polyamide has a melting point of 190 to 220° C. The melting point can be adjusted into a desired level by making the composition of the copolymer and the block chain length appropriate. The melting point referred to in the present invention is a main peak temperature in a chart obtained when any sufficiently-crystallized polymer is subjected to measurement with DSC. Concerning the polymerization degree of the above-mentioned polyamide, relative viscosity $\eta$ rel in sulfuric acid is preferably within the range of about 2.5 to 3.2, considering drawing ability at the time of spinning. Various additives such as a stabilizer and a colorant may be added to the above-mentioned polyamide unless basic properties are damaged.

In the present invention, the sea component of the microfine fiber-forming fiber is preferably a polyethylene-based polymer, and more preferably a low-density polyethylene-based polymer. In general, the polyethylene-based polymer may be any polyethylene-based polymer that is commercially available, or any polyethylene-based polymer that is copolymerized with another monomer unit or other monomer units. Above all, especially preferred is a low-density polyethylene whose MI (melt index) measured according to ASTM D 1238, incorporated herein by reference, is within the range of 50 to 200 g/10 minutes because it has good fluidity and is excellent in spinning stability of the multi-component fiber comprising the polyethylene together with the polyamide-based polymer used in the present invention. This range includes all specific values and subranges therebetween, such as 75, 100, 125, 150 and 175 8/10 minutes. Of course, it is allowable to add such a substance that promotes extracting speed to the polyethylene-based polymer. Since the polyethylene-based polymer is extracted and removed in a subsequent step in the present invention, it is necessary that the polyethylene-based polymer and the polyamide-based polymer are not uniformly blended, that is, they do not have miscibility or compatibility. Specifically, it is necessary that, in the fiber resulting from spinning, the polyethylene as the sea component and the polyamide as the island component are separately present.

Such a sea-island type multi-component fiber, that is, the microfine fiber forming-fiber can be obtained by a method of blending the polymer constituting the island component with the polymer constituting the sea component at a given blend ratio and then melting and spinning the mixture in a single melting system, or a method of melting the polymer constituting the island component and the polymer constituting the sea component in different melting systems and then repeating joint and separation at the spinning top portion plural times to form a mixture system of the two, thereby performing spinning, a method of melting the polymer constituting the island component and the polymer constituting the sea component in different melting systems and then jointing the two polymers at a spinneret, thereby performing spinning, or the like method. From the viewpoint of spinning stability and economy, it is preferred to set the area ratio of the polyamide microfine fiber component of the island component in the sectional area of the sea-island type multi-component fiber of the present invention to the range of 40 to 80%. This range includes all specific values and subranges therebetween, such as 50, 60, 70, and 75%. In the present invention, an island component other than the above-mentioned polyamide may be present as the island component constituting the microfine fiber-forming fiber unless the object of the present invention is damaged.

In the drawing treatment of such a sea-island type multicomponent fiber, it is important to draw the sea-island type multi-component fiber at a temperature not more than the softening point of the polyethylene that is the sea component. This makes it possible to draw the fiber in the state that the polyethylene grasps the polyamide fiber that is the island component, so that the shrinking force of the polyamide fiber can be fixed by polyethylene. This causes area shrinkage by the shrinkage of the polyamide fiber, which results from the softening of the polyethylene upon treatment with hot water after the formation of the fiber-entangled nonwoven fiber. The area shrinkage ratio in this case becomes higher as the temperature at the time of the drawing is lower. In the present invention, the temperature of a drawing bath is preferably from 50 to 70° C. and more preferably 50 to 60° C.

Next, this sea-island type multi-component fiber is made up to a staple fiber having a fineness of 2 to 10 decitex and a fiber length of 15 to 100 mm through treatment steps such as crimping, drying and cutting.

The thus obtained sea-island type multi-component fiber is disentangled with a card and, if necessary, the fiber is blended with other fibers. The resultant is passed through a webber to form a random web or a cross-lap web. The resultant webs are stacked to have a desired weight or thickness. Next, the resultant is subjected to entangling treatment by a known method such as needle-punch or high-speed jet fluid treatment to produce a nonwoven fabric. Of course, the nonwoven fabric may be put on another nonwoven fabric or a woven fabric or knitting in such a manner that a final product will be a nonwoven fabric whose surface side is the above-mentioned sea-island multi-component fiber.

Next, the fiber-entangled nonwoven fabric composed mainly of the sea-island type multi-component fiber is immersed into hot water to shrink it. In this procedure, it is important to treat the nonwoven fabric with the temperature at which the low-density polyethylene that is the sea component of this sea-island type multi-component fiber softens, or higher temperatures in such a manner that the shrinking stress of the polyamide fiber of the island component is not damaged. The temperature of the hot water for this is preferably from 85 to 95° C. and more preferably 90 to 95° C.

It is preferred that the area shrinkage ratio of the fiber-entangled nonwoven fabric is within the range of 15 to 50%. This range includes all specific values and subranges therebetween, such as 20, 25, 30, 35, 40 and 45%. If the area shrinkage ratio is less than 15%, hand touch, denseness and nap-fiber-fixing ability is insufficient. On the other hand, if the area shrinkage ratio is more than 50%, the copolymerization ratio or blend ratio of the polyamide is required to be large in order to make the shrinkage ratio large. Thus, the polyamide fiber deteriorates largely. Moreover, upon hot toluene treatment for converting the microfine fiber-forming fiber to the bundles of the microfine fibers, the swelling degree of the microfine fibers becomes large so that the adhesion between the microfine fibers is highly caused. Thus, the hand touch of the resultant leather-like sheet unfavorably becomes hard and the strength thereof becomes low.

If necessary, the surface of the shrinkage-treated fiber-entangled nonwoven fabric is subjected to hot press to make the surface smooth. Alternatively, the fiber-entangled nonwoven fabric is impregnated with a provisionally fixing agent, a typical example of which is polyvinyl alcohol, to provisionally fix the form of the nonwoven fabric, whereby the form of the nonwoven fabric is not destroyed in any subsequent step. Thereafter, the fiber-entangled nonwoven fabric is impregnated with a solution or dispersion solution of a polymer elastomer and then it is solidified or gelatinized. As the polymer elastomer, a resin that has been conventionally used up to this time is preferred. That is, preferred examples thereof include polyurethane-based resins, polyvinyl chloride-based resins, polyacrylic acid-based resins, polyamino acid-based resins, silicone-based resins, copolymers thereof, and mixtures thereof. Above all, polyurethane-based resins are preferred from the viewpoint of hand touch balance. Among polyurethane resins, there are preferably used ones obtained by reacting the following at a given mole ratio: a polymer diol which has an average molecular weight of 500 to 3000 and is at least one selected from polyester diol, polyether diol, polyether ester diol, polycarbonate diol and the like; at least one diisocyanate selected from aromatic, alicyclic and aliphatic diisocyanates such as 4,4'-diphenylmethane diisocyanate, isophrone diisocyanate and hexamethylene diisocyanate; and at least one low-molecular compound having two or more active hydrogen atoms, such as ethylene glycol and ethylenediamine. This range for the molecular weight of the polymer includes all specific values and subranges therebetween, such as 600, 700, 800, 900, 1000, 1500, 2000 and 2500.

If necessary, an additive such as a colorant, a coagulation adjuster, or an antioxidant is blended with the elastic polymer solution. Preferably, the weight ratio of the polymer elastomer in the fibrous substrate after the treatment for conversion into the microfine fiber is within the range of 20 to 60% (solid basis). This range includes all specific values and subranges therebetween, such as 25, 30, 40, 45, 50 and 55%. It is preferred for keeping the balance between the fiber and the elastic polymer to adjust the weight ratio of the solid basis in accordance with the fields of products. As the coagulating method of the polymer elastomer, a wet coagulating method is preferred because a porous solidified product can be obtained to exhibit natural-leather like hand touch.

An artificial leather sheet substrate comprising the microfine fiber and the polymer elastomer can be obtained by dissolving or decomposing/removing the sea component of the sea-island type multi-component fiber (fibrous substrate), which is impregnated with the solution or dispersion solution of the polymer elastomer and solidified, by means of a liquid that is a solvent or a discomposing agent for the sea component and is not a solvent or a discomposing agent for the polymer elastomer and the island component. Especially preferably, in the present invention an artificial leather sheet substrate comprising the microfine fiber and the polymer elastomer can be obtained by dissolving and removing the sea component, that is, the polyethylene, with hot toluene. The fineness of the microfine fiber is preferably 0.3 decitex or less and more preferably within the range of 0.1 to 0.001 decitex (inclusive of all specific values and subranges therebetween, such as 0.05, 0.02, 0.01, 0.005 and 0.002) from the viewpoint of the hand touch, the sense of touch and appearances like leather. In order to remove the remaining toluene from the fibrous substrate from which the polyethylene component is dissolved and removed, the fibrous substrate is immersed in hot water. At that time, the above-mentioned releasing agent is preferably added to the hot water. As described above, by the addition of the releasing agent, it is possible to prevent the phenomenon that the microfine fibers or microfine fiber bundles are excessively coagulated upon drying treatment after the addition.

In order to obtain a suede-like artificial leather sheet, this artificial leather sheet substrate is sliced into plural pieces along its thickness direction if necessary. Thereafter, at least one surface of the surfaces is subjected to napping treatment to form a fiber napped surface made mainly of the microfine fiber. The method for forming the fiber napped surface may be a known method such as buffing with sandpaper. The preferred thickness of the suede-like artificial leather is in the range of 0.4 to 2.5 mm. This range includes all specific values and subranges therebetween, such as 0.5, 0.8, 1.0, 1.25, 1.5, 1.75, 2.0 and 2.25 mm.

Next, the obtained suede-like artificial leather sheet substrate is dyed. The dyeing is performed using a dye that the terminal amino group of the polyamide can be a dyeing group. Examples of such a dye include acid dyes, metal complex dyes and reactive dyes. The dyed suede-like fibrous substrate is subjected to finishing treatment such as crumpling, softening treatment or brushing, so as to obtain a suede-like artificial leather sheet which has elegant appearances and does not cause its nap to fall away.

The artificial leather substrate of the present invention can be suitably used in the field of grain surface-like artificial leather. That is, a grain -like surface is formed by bonding a film that becomes the grain-like surface to the surface of this artificial leather substrate or by coating or gravure-coating the surface with a resin emulsion, a resin solution, a molten resin or the like, and subsequently the surface is subjected to finishing treatment such as embossing or coloring so as to obtain a grain surface-like artificial leather having softness and denseness.

The hot toluene swelling degree and the fineness of the microfine fiber, referred to in the present invention, means values measured by the following methods.

Method of Measuring the Hot Toluene Swelling Degree

Pellets of a resin for a microfine fiber is vacuum-dried at 105° C. for 4 hours, so that its water content is within the range of 300 to 600 ppm. Thereafter, the pellets are molded into a film having a thickness of 100 $\mu$m at 270° C. with a press molding machine. After the molding, the film is allowed to stand still in a room of 25° C. for 4 hours, to obtain a sample for the test. The sample is cut into square pieces, each side of which has a length of 10 cm. The weight ($W_O$) of the piece is measured, and then the piece is immersed in hot toluene at 90° C. for 1 hour. The piece is taken out from the hot toluene. The toluene adhering on the surface is wiped off. The weight (W) of the piece is measured and then the swelling ratio is calculated according to the following calculating equation:

$$\text{Swelling ratio (wt \%)}=(W-W_O)\times 100/W_O$$

Fineness of a Microfine Fiber

A microphotograph of a cross section of a microfine fiber-forming fiber is taken and then the number of the islands is counted on the cross section of the single fiber. The fineness is obtained by dividing the total fineness of the microfine fiber bundle of the resultant final product by the number of the islands.

Advantages of the Invention

The leather-like sheet substrate of the present invention is soft and is excellent in denseness, dyeability and color fastness. The sheet is suitable, as a suede-like artificial leather or a grain surface like artificial leather, for fields for which high quality is required, for example, for clothing. The sheet is high in denseness of surface napped fiber and is excellent in hand touch, writing effect and draping ability, especially as a suede-like artificial leather.

The shrinkage ratio, which is unstable according to producing methods in the prior art, can be obtained stably in the industry.

EXAMPLES

Having generally described this invention, a further understanding can be obtained by reference to certain specific examples which are provided herein for purposes of illustration only and are not intended to be limiting unless otherwise specified. "Parts" and "%" in Examples represent "parts by weight" and "% by weight", respectively, unless otherwise specified.

Example 1

50 parts of a copolymerized nylon comprising 6-nylon units and 12-nylon units (6-nylon/12-nylon=80/20, melting point: 202° C., and hot toluene swelling degree: 5.5%) as an island component and 50 parts of polyethylene (melt index=70) as a sea component were melted in a single melting system, and spun to obtain a microfine fiber-forming fiber having a fineness of 10 decitex. Cross sections of the fiber were observed. The average number of islands was about 600. Next, the obtained fiber was drawn by 3.4 times in a hot water bath of 50° C. and was crimped. Thereafter, the fiber was cut to have a fiber length of 51 mm, to produce a staple fiber having a fineness of 3.0 decitex. This staple fiber was disentangled with a card and converted into webs with a cross-lap webber. Next, the webs were subjected to a needle punching treatment, to obtain a fiber-entangled nonwoven fabric having a density of 650 g/m$^2$. This fiber-entangled nonwoven fabric was immersed in hot water of 95° C., causing shrinkage by about 35% in area, and formed into a fiber-entangled nonwoven fabric having a density of 1000 g/m$^2$. This fiber-entangled nonwoven fabric was then impregnated with a composition solution, as a polymer elastomer, comprising 13 parts of a polyurethane composition composed mainly of a polyether-based polyurethane and 87 parts of dimethylformamide (hereinafter referred to as DMF), followed by wet coagulation and washing with water. Thereafter, the polyethylene in the microfine fiber-forming fiber was removed by extraction with hot toluene of 85° C., and then toluene in the substrate was removed in hot water of 95° C. by azeotropy. The wet fibrous substrate from which toluene was removed was replaced by an aqueous solution of 1% (net) of a salt compound of a polyamide derivative (compound name: epichlorohydrin quaternary salt of behenic acid triethylenetetramine amide) and dried at 140° C. to obtain a fibrous substrate comprising a microfine fiber bundle-form fiber of a 6-nylon/12-nylon copolymerized nylon and a polyurethane and having a thickness of about 2.2 mm. This fibrous substrate was sliced into 2 parts to obtain a fibrous substrate for a suede-like artificial leather, which had a thickness of about 1.1 mm.

Cross sections of the microfine fiber bundle of the fibrous substrate for this suede-like artificial leather were observed with an electron microscope, so that the average fineness thereof was 0.0032 decitex. One surface of this substrate was buffed to adjust its thickness to 0.80 mm, and then the other surface was treated with an emery buffing machine to form a microfine fiber napped surface. The substrate was dyed with Irgalan Brown 2BLN (Chiba Geigy) at a concentration of 4% owf. The substrate was finished. The resultant suede-like artificial leather was vividly dyed, and had excellent color fastness and denseness of the napped surface and good appearances, hand touch, and draping ability. The nap was hardly caused to fall out. From the results of the present Example and Comparative Example 3 described below, it can be understood that the salt compound of the polyamide derivative was present inside the microfine fiber bundle and between the bundles to prevent adhesion between the fibers.

Example 2

50 parts of a copolymerized nylon comprising 6-nylon units and 12-nylon units (6-nylon/12-nylon=90/10, melting point: 213° C., and hot toluene swelling degree: 3%) as an island component and 50 parts of polyethylene (melt index=70) as a sea component were melted in different melting systems. Joint and separation of the two at the spinning top portion were repeated plural times to form a mixture system of the two. This spinning method provided a microfine fiber-forming fiber having a fineness of 16 decitex. Cross sections of the fiber were observed. The average number of islands was about 200. Next, the obtained fiber was drawn by 3.8 times in a hot water bath of 50° C. and was crimped. Thereafter, the fiber was cut to have a fiber length of 51 mm, to produce a staple fiber having a fineness of 4. 2 decitex. This staple fiber was disentangled with a card and converted into webs with a cross-lap webber. Next, the webs were subjected to a needle punching treatment, to obtain a fiber-entangled nonwoven fabric having a density of 780 g/m$^2$. This fiber-entangled nonwoven fabric was immersed in hot water of 95 ° C., causing shrinkage by about 20% in area, and formed into a fiber - entangled nonwoven fabric having a density of 975 g/m$^2$. This fiber-entangled nonwoven fabric was then impregnated with a composition solution, as a polymer elastomer, comprising 13 parts of a polyurethane composition composed mainly of a polyether-based polyurethane and 87 parts of DMF, followed by wet coagulation and washing with water. Thereafter, the polyethylene in the microfine fiber-forming fiber was removed by extraction with hot toluene, and then toluene in the substrate was removed in hot water of 95° C. by azeotropy. The wet fibrous substrate from which toluene was removed was replaced by an aqueous solution of 1%(net) of a salt compound of a polyamide derivative (compound name: epichlorohydrin quaternary salt of behenic acid triethylenetetramine amide) and dried at 140° C. to obtain a fibrous substrate comprising a microfine fiber bundle-form fiber of a 6-nylon/12-nylon copolymerized nylon and a polyurethane and having a thickness of about 2.2 mm. This fibrous substrate was sliced into 2 parts to obtain a fibrous substrate, which had a thickness of about 1.1 mm.

Cross sections of the microfine fiber bundle of the fibrous substrate were observed with an electron microscope, so that the average fineness thereof was 0.012 decitex. One surface of this substrate was buffed to adjust its thickness to 0.80 mm, and then the other surface was treated with an emery buffing machine to form a microfine fiber napped surface. The substrate was dyed with Irgalan Brown 2BLN (Ciba Geigy) at a concentration of 4% owf. The substrate was finished. In the same manner in Example 1, the resultant suede-like artificial leather was vividly dyed, and had excellent color fastness and denseness of the napped surface and good appearances, hand touch, feel, and draping ability. The nap was hardly caused to fall out. From the results of the present Example and Comparative Example 4 described below, it can be understood that the salt compound of the polyamide derivative was present inside the microfine fiber bundle and between the bundles to prevent adhesion between the fibers.

Comparative Example 1

50 parts of a copolymerized nylon comprising 6-nylon units and 12-nylon units (6-nylon/12-nylon=50/50, melting point: 125° C., and hot toluene swelling degree: 14%) as an island component and 50 parts of polyethylene (melt index=70) as a sea component were melted in a single melting system, and spun to obtain a microfine fiber-forming fiber having a fineness of 10 decitex. Cross sections of the fiber were observed. The average number of islands was about 600. Next, the obtained fiber was drawn by 3.4 times in a hot water bath of 50° C. and was crimped. Thereafter, the fiber was cut to have a fiber length of 51 mm, to produce a staple fiber having a fineness of 3.0 decitex. This staple fiber was disentangled with a card and converted into webs with a cross-lap webber. Next, the webs were subjected to a needle punching treatment, to obtain a fiber- entangled nonwoven fabric having a density of 600 g/m$^2$. This fiber-entangled nonwoven fabric was immersed in hot water of 95° C., causing shrinkage by about 55% in area, and formed into a fiber-entangled nonwoven fabric having a density of 1300 g/m$^2$. The treatment after the impregnation with a polymer elastomer was conducted in the same manner as in Example 1.

In the resultant suede-like artificial leather, adhesion between the microfine fibers was high, and its hand touch was hard. Its draping ability was also insufficient. Concerning its physical properties, strength was short.

Comparative Example 2

50 parts of a 6–12 copolymerized nylon (6-nylon/12-nylon 97/3, melting point: 217° C., and hot toluene swelling degree: 1%) as an island component and 50 parts of polyethylene (melt index=70) as a sea component were melted in different melting systems. Joint and separation of the two at the spinning top portion were repeated plural times to form a mixture system of the two. This spinning method provided a microfine fiber-forming fiber having a fineness of 16 decitex. Cross sections of the fiber were observed. The average number of islands was about 200. Next, the obtained fiber was drawn by 3.8 times in a hot water bath of 50° C. and was crimped. Thereafter, the fiber was cut to have a fiber length of 51 mm, to produce a staple fiber having a fineness of 4.2 decitex. This staple fiber was disentangled with a card and converted into webs with a cross-lap webber. Next, the webs were subjected to a needle punching treatment, to obtain a fiber-entangled nonwoven fabric having a density of 850 g/m$^2$. This fiber-entangled nonwoven fabric was immersed in hot water of 95° C., causing shrinkage by about 11% in area, and formed into a fiber-entangled nonwoven fabric having a density of 970 g/m$^2$. The treatment after the impregnation with a polymer elastomer was conducted in the same manner as in Example 2.

In the resultant suede-like artificial leather, adhesion between the microfine fibers was not observed, but fall of nap of the surface napped fiber was remarkable. Its hand touch was paper-like, and softness and appearance of the surface nap were poor.

Comparative Example 3

The same manner as in Example 1 was performed except that replacement of the wet fibrous substrate from which toluene was removed by the aqueous solution of the salt compound of the polyamide derivative was omitted and a directly drying method was used, so as to produce a suede-like artificial leather. In the resultant suede-like artificial leather, adhesion between the microfine fibers was high, and its was hard. Its draping ability was also insufficient.

Comparative Example 4

The same manner as in Example 2 was performed except that replacement of the wet fibrous substrate from which toluene was removed by the aqueous solution of the salt compound of the polyamide derivative was omitted and a directly drying method was used, so as to produce a suede-like artificial leather. In the same manner as in Comparative Example 3, in the resultant suede-like artificial leather, adhesion between the microfine fibers was high, and its hand touch was hard. Its draping ability was also insufficient.

Obviously, numerous modifications and variations of the present invention are possible in light of the above teachings. It is therefore to be understood that within the scope of the appended claims, the invention may be practiced otherwise than as specifically described herein.

This application is based on Japanese Patent Application Serial No. 69391, filed on Mar. 16, 1999, and incorporated herein by reference in its entirety.

What is claimed is:

1. An artificial leather sheet substrate, comprising:

a fiber entangled nonwoven fabric comprising bundles of polyamide-based microfine fibers comprising a polyamide or a polyamide composition having a hot toluene swelling degree of 2 to 10%, and having a fineness of 0.1 decitex or less;

an elastic polymer and a releasing agent between the bundles; and a releasing agent inside of the bundles.

2. The artificial leather sheet substrate of claim 1, wherein the polyamide-based fiber is a fiber comprising a polyamide or a polyamide composition comprising a nylon-6 unit and a nylon-12 unit.

3. The artificial leather sheet substrate of claim 1, wherein the releasing agent is a salt compound of a polyamide derivative or is a silicone-based compound.

4. The artificial leather sheet substrate of claim 1, wherein the releasing agent between the bundles and the releasing agent inside of the bundles is the same.

5. The artificial leather sheet substrate of claim 1, wherein the polyamide has a melting point of 185° C. or higher.

6. The artificial leather sheet substrate of claim 1, wherein the polyamide has a melting point of 190 to 220° C.

7. The artificial leather sheet substrate of claim 1, wherein the polyamide or polyamide composition has a fineness of 0.001 to 0.1 decitex.

8. The artificial leather sheet substrate of claim 1, wherein the polyamide or polyamide composition has a hot toluene swelling degree of 4 to 7%.

9. The artificial leather sheet substrate of claim 1, wherein the sheet has a thickness of 0.4 to 2.5 mm.

10. The artificial leather sheet substrate of claim 1, wherein the amount of releasing agent in the sheet is 0.2 to 1% by weight, solid basis, of the sheet.

11. The artificial leather sheet substrate of claim 1, wherein the polyamide-based fiber is a fiber comprising a polyamide or a polyamide composition comprising a nylon-6 unit and a nylon-12 unit in a weight ratio of 60/40 to 95/5.

12. A process for producing the artificial leather sheet substrate of claim 1, comprising:

producing a fiber entangled nonwoven fabric from a polyamide microfine fiber-forming fiber, treating the fiber entangled nonwoven fabric with hot water to shrink the fabric by 15 to 50% in area, impregnating the shrunk fiber entangled nonwoven fabric with an elastic polymer, converting the microfine fiber-forming fiber into bundles of microfine fine fibers, adding a releasing agent to the bundles of microfine fine fibers, and drying the bundles of microfine fine fibers.

13. The process of claim 12, wherein the polyamide-based fiber is a fiber comprising a polyamide or a polyamide composition comprising a nylon-6 unit and a nylon-12 unit.

14. The process of claim 12, wherein the releasing agent is a salt compound of a polyamide derivative or is a silicone-based compound.

15. An artificial leather sheet substrate, comprising:

a fiber entangled nonwoven fabric comprising bundles of polyamide-based microfine fibers comprising a polyamide or a polyamide composition having a hot toluene swelling degree of 2 to 10%, and having a fineness of 0.1 decitex or less;

an elastic polymer and a releasing agent between the bundles; and a releasing agent inside of the bundles;

wherein the polyamide or the polyamide composition comprise a nylon-6 unit and a nylon-12 unit.

16. An artificial leather sheet substrate, comprising:

a fiber entangled nonwoven fabric comprising bundles of polyamide-based microfine fibers comprising a polyamide or a polyamide composition having a hot toluene swelling degree of 2 to 10%, and having a fineness of 0.1 decitex or less;

an elastic polymer and a releasing agent between the bundles; and a releasing agent inside of the bundle;

wherein the releasing agent is a salt of a polyamide compound or is a silicone-based compound.

17. The artificial leather sheet substrate according to claim 1, wherein said microfine fibers are obtained from microfine fiber-forming fibers having a sea-island section structure, wherein an island component comprises said polyamide and a sea component comprises polyethylene.

* * * * *

UNITED STATES PATENT AND TRADEMARK OFFICE

CERTIFICATE OF CORRECTION

PATENT NO. : 6,517,938 B1
DATED : February 11, 2003
INVENTOR(S) : Andoh et al.

It is certified that error appears in the above-identified patent and that said Letters Patent is hereby corrected as shown below:

Title page,
Item [73], Assignee, should read:
-- [73] Assignee: Kuraray Co., Ltd., Kurashiki (JP) --

Signed and Sealed this

Twenty-fourth Day of June, 2003

JAMES E. ROGAN
*Director of the United States Patent and Trademark Office*